US007680290B2

(12) United States Patent
Ko et al.

(10) Patent No.: US 7,680,290 B2
(45) Date of Patent: Mar. 16, 2010

(54) SOUND REPRODUCING APPARATUS AND METHOD FOR PROVIDING VIRTUAL SOUND SOURCE

(75) Inventors: Sang-chul Ko, Seoul (KR); Jung-ho Kim, Yongin-si (KR); Jun-tai Kim, Yongin-si (KR); Young-tac Kim, Seongnam-si (KR); Kyung-yeup Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1279 days.

(21) Appl. No.: 11/180,568

(22) Filed: Jul. 14, 2005

(65) Prior Publication Data

US 2006/0013419 A1 Jan. 19, 2006

(30) Foreign Application Priority Data

Jul. 14, 2004 (KR) ..... 10-2004-0054805

(51) Int. Cl.
*H04R 5/02* (2006.01)
*H04R 5/00* (2006.01)

(52) U.S. Cl. ..... 381/310; 381/309; 381/307; 381/17; 381/18; 381/19

(58) Field of Classification Search ..... 381/1, 381/17–19, 300, 303, 307, 309–310
See application file for complete search history.

(56) References Cited

U.S. PATENT DOCUMENTS 5,761,315 A * 6/1998 Iida et al. ..... 381/18
6,766,028 B1 * 7/2004 Dickens ..... 381/310
2003/0118192 A1 * 6/2003 Sasaki ..... 381/17

FOREIGN PATENT DOCUMENTS

| | | | |
|---|---|---|---|
| EP | 0571455 | B1 | 1/2002 |
| JP | 2-200100 | A | 8/1990 |
| JP | 3-32300 | A | 2/1991 |
| JP | 11-187480 | A | 7/1999 |
| JP | 2002-44795 | A | 2/2002 |
| JP | 2002-171460 | A | 6/2002 |
| JP | 2003-516069 | A | 5/2003 |
| KR | 2001-0001993 | A | 1/2001 |
| NL | 1014777 | C2 | 10/2002 |
| WO | 9725834 | A2 | 7/1997 |
| WO | 03015471 | A2 | 2/2003 |
| WO | 2004028204 | A2 | 4/2004 |
| WO | 2006054270 | A1 | 5/2006 |

* cited by examiner

*Primary Examiner*—Vivian Chin
*Assistant Examiner*—George C Monikang
(74) *Attorney, Agent, or Firm*—Sughrue Mion, PLLC

(57) ABSTRACT

A sound reproducing apparatus for providing an optimal virtual sound source and a sound reproducing method therefor are provided. The sound reproducing apparatus includes a virtual sound signal generation unit for generating more than one virtual sound signal corresponding to locations and the number of target virtual sound sources on the basis of more than one inputted sound signal, and a virtual sound signal downmix unit for downmixing said more than one virtual sound signal to virtual sound signal outputs corresponding to a predetermined number of output channels. The number and locations of diversely variable virtual sound sources are provided, thereby obtaining an effect of providing an optimal virtual sound source adaptively depending on each different environment.

20 Claims, 4 Drawing Sheets

SOUND REPRODUCING APPARATUS AND METHOD FOR PROVIDING VIRTUAL SOUND SOURCE

CROSS-REFERENCE TO RELATED APPLICATIONS

This application claims benefit from Korean Patent Application No. 10-2004-0054805, filed on Jul. 14, 2004, in the Korean Intellectual Property Office, the disclosure of which is incorporated herein by reference.

BACKGROUND OF THE INVENTION

1. Field of the Invention

The present invention relates to a sound reproducing apparatus and a method for providing a virtual sound source, and more particularly, to a sound reproducing apparatus for providing an optimal virtual sound source by converting sound signals inputted in multi-channels into at least more than one virtual sound source which is outputted thereafter.

2. Description of the Related Art

In the conventional audio industry field, it has been attempted to reproduce a sound that expresses presence vividly and accurately by creating a sound in a one-dimensional front direction or in a two-dimensional plane level. That is, the multimedia industry has been focused to develop a technology that allows acoustic information, more particularly, sound signals to be recorded and reproduced vividly and accurately along with provided visual information. Therefore, most of currently manufactured sound reproducing apparatuses are aimed at reproducing stereo sound signals instead of mono sound signals. However, when the stereo sound signals are reproduced, a range of perceiving actual presence by the reproduced sound signals is limited depending on allocation of speakers. For this reason, there are many studies on improving reproducibility of speakers to broaden the range of perceiving the actual presence and on generating virtual signals by signal processing.

As a result of these active studies, one representative system is a stereo surround sound system using five speakers. This sound system processes separately virtual signals outputted to speakers at the rear. A method for generating these virtual signals is to give a delay as signals move spatially, decrease sizes of the signals and then transmit these downsized signals to the rear side. Most currently manufactured sound reproducing apparatuses take a stereo sound system of Dolby Prologic Surround that allows a user to be able to experience a dynamic sound system as is found in a theater as long as there is a sound reproducing apparatus capable of reproducing Dolby Prologic Surround sounds.

Although an increase in the number of channels provides an effect on reproducing an improved quality of sound, the number of speakers needs to be increased as many as the number of channels. As a result, there are problems in increasing costs and requiring more spaces to install speakers.

These problems can be improved by applying the study about how humans hear sounds generated in a three-dimensional space. Particularly, there are numerous studies on the human auditory system that allows one to perceive a three-dimensional sound space, and thus, it is possible to create virtual sound sources recently. These virtual sound sources are applied in various fields.

In the case of applying the virtual sound source concept to sound reproducing apparatuses, that is, if it is possible to employ a predetermined number, for instance, two speakers instead of employing a larger number of speakers to provide multi-directional sound sources, it is greatly advantageous in realizing a sound reproducing apparatus with intended functions. It is economically advantageous by being able to employ the decreased number of speakers. Also, another advantage is that it is possible to reduce a space occupied by a sound system.

FIG. 1 is a diagram showing locations of virtual sound sources employed in a conventional sound reproducing apparatus.

In this drawing, virtual sound sources are outputted through frontal left and right speakers 10 and 12. In the case of applying the virtual sound sources to the conventional sound reproducing apparatus, a reference location of an actual sound source originated from a Dolby surround stereo sound reproducing apparatus is applied for determining locations of virtual sound sources 20, 22, 24, 26 and 28 by taking a user 30 as a reference point.

The above reference location can be an ideal sound reproducing location when a plurality of actual speakers, which are actual sound sources as being adopted in a stereo sound reproducing apparatus, are employed. However, because of a difficulty in artificially adjusting a location of sound toward a rear side due to a limitation in reproducing stereo sounds when the frontal left and right speakers 10 and 12 are solely used, this reference location can not be determined to be the best sound reproducing location in the stereo sound reproducing apparatus using only the frontal left and right speakers 10 and 12.

Also, virtual sound sources may have different optimal locations from each other depending on a type of each sound reproducing apparatus and an environment at which a sound reproducing apparatus is reproduced. However, for the conventional sound reproducing apparatus, the locations of the virtual sound sources are fixed to the locations in which the speakers of the Dolby surround stereo sound reproducing apparatus are placed. Hence, there may be a problem of adaptive allocation of the virtual sound sources.

SUMMARY OF THE INVENTION

It is, therefore, an object of the present invention to provide a sound reproducing apparatus for generating more than one virtual sound source based on sound signals inputted in multi-channels and providing an optimal virtual sound source by being capable of selecting the number and a location of the optimal virtual sound source among predetermined numbers and locations of virtual sound sources and a method therefor.

In accordance with one aspect of the present invention, there is provided a sound reproducing apparatus for providing an optimal virtual sound source, including a virtual sound signal generation unit for generating more than one virtual sound signal corresponding to locations and the number of target virtual sound sources on the basis of more than one inputted sound signal, and a virtual sound signal downmix unit for downmixing said more than one virtual sound signal to virtual sound signal outputs corresponding to a predetermined number of output channels.

The virtual sound signal generation unit includes an adder for adding at least more than two sound signals among said more than one sound signal and generating an added sound signal, a subtracter for subtracting at least more than two sound signals among said more than one sound signal and generating a subtracted sound signal, and a gain adjustment unit for adjusting said more than one sound signal, the added sound signal and the subtracted sound signal to predetermined optimal gains by corresponding to locations and the number of the target virtual sound sources. Also, the virtual sound signal further includes a signal transfer filter unit for filtering said more than one sound signal, the added sound signal and the subtracted sound signal, which are adjusted, with use of predetermined optimal signal transferring filters by corresponding to locations and the number of the target virtual sound sources to thereby generate said more than one virtual sound signal.

Also, the virtual sound signal downmix unit includes a spatial transfer function processing unit for separating more than one virtual sound signal such that said more than one virtual sound signal corresponds to the number of the output channels and processing each separated virtual sound signal by using the separate spatial transfer function such that said each separated virtual sound signal corresponds to the respective output channels, and at least one adder of which number corresponds to the number of the output channels and for adding said each virtual sound signal processed by the respective spatial transfer function such that said each virtual sound signal corresponds to the respective output channels.

Furthermore, the sound reproducing apparatus further includes an input unit for selecting one virtual sound source providing mode among more than one virtual sound source providing mode corresponding to the number and locations of virtual sound sources.

In addition, the virtual sound source signal generation unit generates more than one virtual sound source signal corresponding to the number and locations of virtual sound sources based on the selected virtual sound source providing mode when the one virtual sound source providing mode is selected among said more than one virtual sound source providing mode through the use of the input unit.

Preferably, locations and the number of the virtual sound sources are determined by considering one of a type of a sound reproducing mode and a type of a sound reproducing apparatus. Also, the preferable number of output channels is two.

In accordance with another aspect of the present invention, there is provided a sound reproducing method for providing an optimal virtual sound source, including the steps of generating more than one virtual sound signal corresponding to locations and the number of target virtual sound sources on the basis of more than one inputted sound signal, and downmixing said more than one virtual sound signal to more than one virtual sound signal output corresponding to a predetermined number of output channels.

BRIEF DESCRIPTION OF THE DRAWINGS

The above aspects and features of the present invention will be more apparent by describing exemplary embodiments of the present invention with reference to the accompanying drawings, in which.

DETAILED DESCRIPTION OF EXEMPLARY EMBODIMENTS

Figure 1:
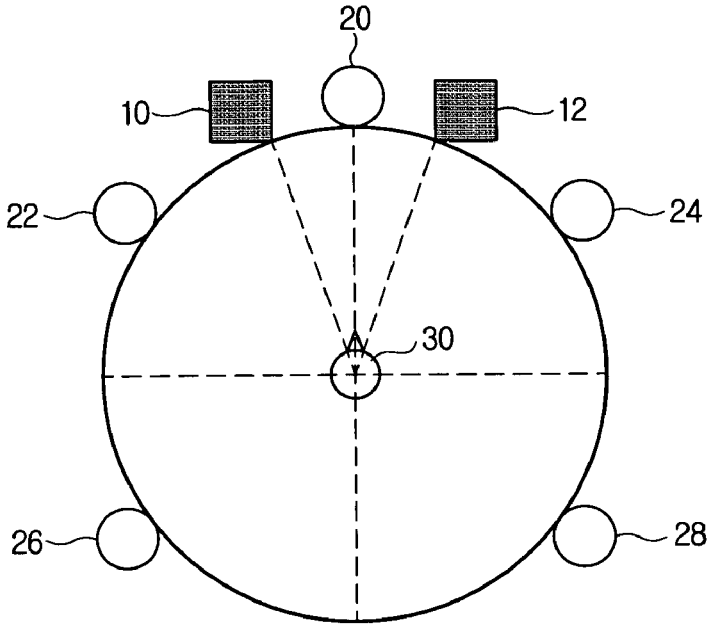
FIG. 1 (PRIOR ART)
FIG. 1 is a diagram showing locations of virtual sound sources adopted in a conventional sound reproducing apparatus.

Exemplary embodiments of the present invention will be described in greater detail with reference to the accompanying drawings.

In the following description, same drawing reference numerals are used for the same elements even in different drawings. The matters defined in the description such as a detailed construction and elements are provided to assist in a comprehensive understanding of the invention. Thus, it is apparent that the present invention can be carried out without those defined matters. Also, well-known functions or constructions are not described in detail since they would obscure the invention in unnecessary detail.

Although a sound reproducing apparatus in accordance with an exemplary embodiment is assumed to have frontal left and right speakers, the present invention is not limited by the number of the speakers.

Figure 2:
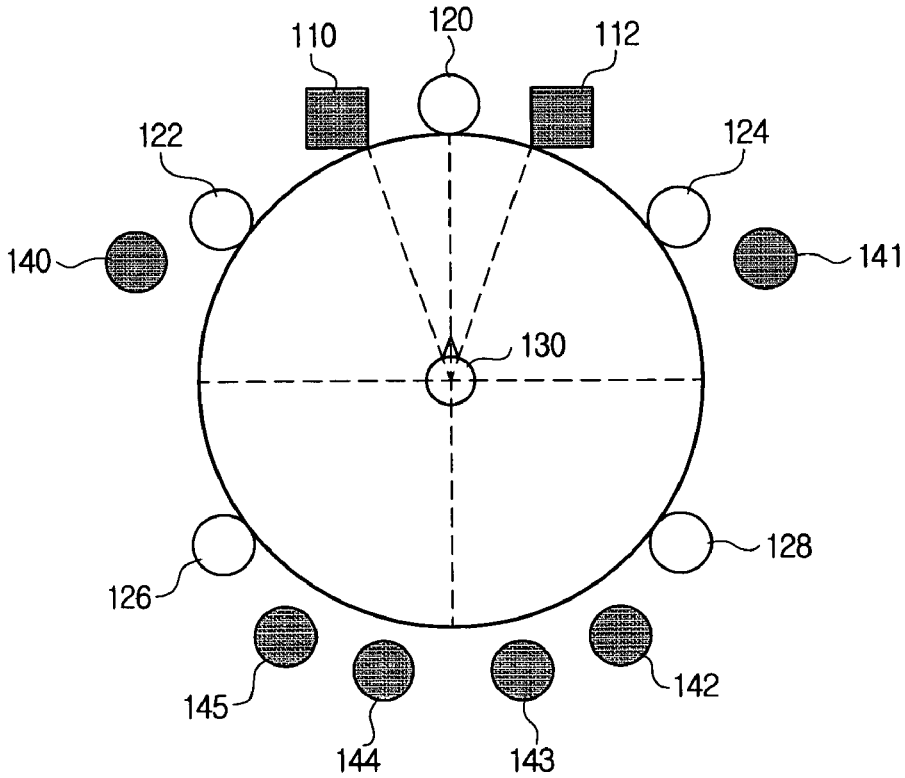
FIG. 2 is a diagram showing locations and the number of virtual sound sources adopted in a sound reproducing apparatus in accordance with an exemplary embodiment of the present invention.

FIG. 2 is a diagram showing locations and the number of virtual sound sources adopted in a sound reproducing apparatus in accordance with an exemplary embodiment of the present invention.

As shown, for locations of virtual sound sources determined by frontal left and right speakers 110 and 112, reference locations 120, 122, 124, 126, and 128 of actual sound sources of a conventional Dolby surround stereo sound reproducing apparatus are not applied, and virtual sound sources 140, 141, 142, 143, 144, and 145 having locations and the number as corresponding to a request by a user 130 are generated by taking the user 130 as a reference point. In this drawing, there are six virtual sound sources set according to a request made by the user 130.

Figure 3:
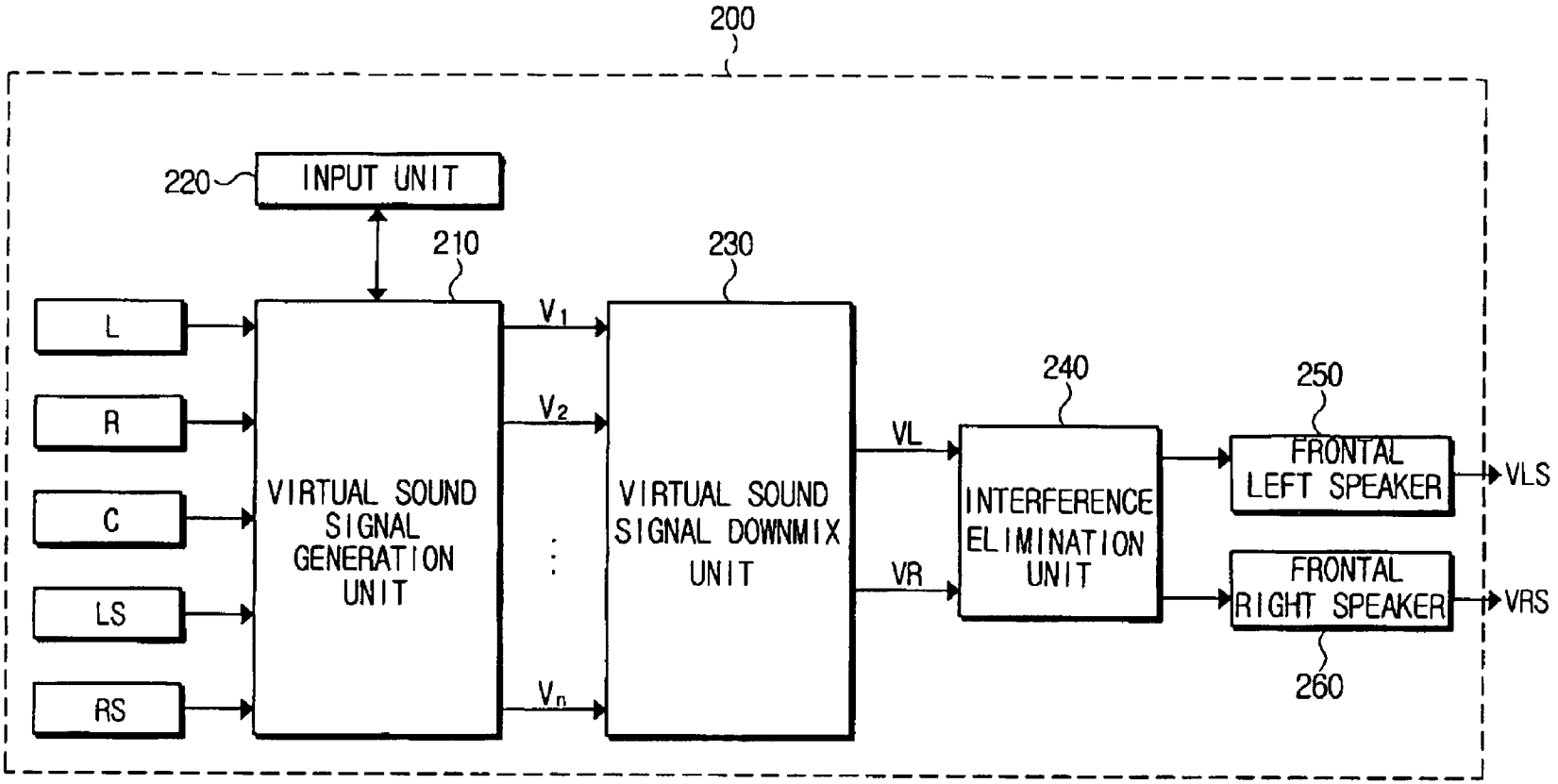
FIG. 3 is a block diagram showing a sound reproducing apparatus in accordance with an exemplary embodiment of the present invention.

FIG. 3 is a block diagram showing a sound reproducing apparatus adopting frontal left and right speakers in accordance with an exemplary embodiment of the present invention.

A sound reproducing apparatus 200 includes a virtual sound signal generation unit 210, an input unit 220, a virtual sound signal downmix unit 230, an interference elimination unit 240, and frontal left and right speakers 250 and 260.

Although the exemplary embodiment of the present invention exemplifies that sound signals provided from an external sound signal providing apparatus (not shown) are inputted to the sound reproducing apparatus 200 in five channels including a left channel L, a right channel R, a center channel C, a left surround channel LS, and a right surround channel RS, the present invention is not limited to these preset number of channels.

Once sound signals provided from the external sound signal providing apparatus are inputted through the left channel L, the right channel R, the center channel C, the left surround channel LS, and the right surround channel RS, the virtual sound signal generation unit 210 generates at least more than one virtual sound signal through a predetermined process in accordance with a request made by a user. Herein, the generated virtual sound signals are expressed as $(V_1, V_2, \ldots, V_n)$, where n is a positive number. Also, the virtual sound signals $(V_1, V_2, \ldots, V_n)$ are determined by at least more than one predetermined virtual sound source providing mode, that is, locations and the number of virtual sound sources targeted to be generated (hereinafter referred to as the target virtual sound sources) are determined by a user's request. Among more than one virtual sound source providing mode, when a user listens to an inputted sound signal and selects one virtual sound source providing mode that is to be applied, the number of virtual sound signals generated according to the selected virtual sound source providing mode is changed. It is possible to set said at least more than one virtual sound source providing mode variably depending on an environment in which virtual sound sources are generated, a type of a sound reproducing apparatus that generates virtual sound sources and a mode of a sound reproducing apparatus that generates virtual sound sources, and the input unit 220 serves a role in setting an intended virtual sound source providing mode. It is also possible to configure the sound reproducing apparatus 200 differently from the above-described configuration such that the virtual sound source providing mode is automatically set by an inputted sound signal.

The at least more than one virtual sound signal ($V_1$, $V_2$, . . . , $V_n$) is transmitted to the virtual sound signal downmix unit 230, which in turn, downmixes said at least more than one virtual sound signal ($V_1$, $V_2$, . . . , $V_n$) through a predetermined process to thereby generate a left virtual sound signal output VL and a right virtual sound signal output VR. Then, the downnmixed left and right virtual sound signal outputs VL and VR are transmitted to the interference elimination unit 240. Next, the interference elimination unit 240 proceeds with an interference elimination process with respect to the transmitted left and right virtual sound signal outputs VL and VR. Detailed description about the interference elimination process has been omitted. Afterwards, the left virtual sound signal output VL and the right virtual sound signal output VR are outputted as a left virtual sound source VLS and a right virtual sound source VRS through a left speaker 250 and a right speaker 260, respectively.

Figure 4:
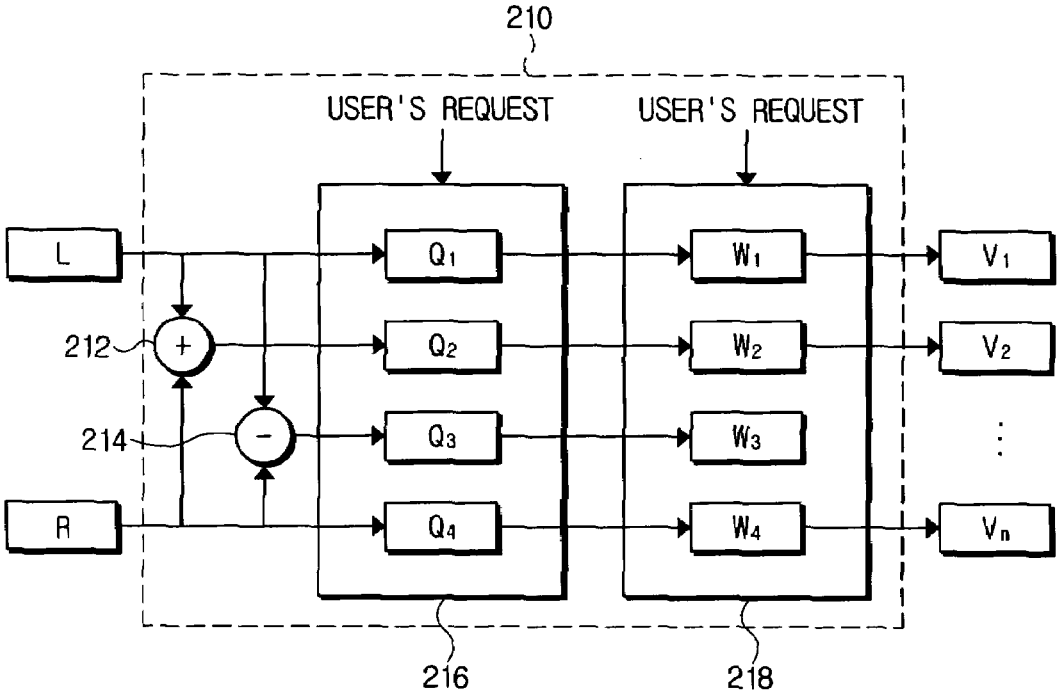
FIG. 4 is a block diagram showing an inner side of a virtual sound signal generation unit shown in FIG. 3.

FIG. 4 is a block diagram showing an inner side of the virtual sound signal generation unit shown in FIG. 3. In this drawing, it should be noted that only left and right sound signals L and R are depicted among numerously inputted sound signals and, the present invention is not limited to this exemplary embodiment.

When a plurality of sound signals are inputted, the virtual sound signal generation unit 210 generates more than one virtual sound signal ($V_1$, $V_2$, . . . , $V_n$), which is subsequently transmitted to the virtual sound signal downmix unit 230. In this case, as described above, the number of virtual sound signals ($V_1$, $V_2$, . . . , $V_n$) varies depending on a virtual sound source providing mode selected by a user through the input unit 220. Also, the number of virtual sound signals ($V_1$, $V_2$, . . . , $V_n$) is identical to that of target virtual sound sources, and thus, the number of virtual sound signals ($V_1$, $V_2$, . . . , $V_n$) can be two, or more than two, depending on a request made by a user.

The virtual sound signal generation unit 210 includes an adder 212, a subtracter 214, a gain adjustment unit 216, and a signal transfer filter unit 218.

The adder 212 and the subtracter 214 add and subtract the inputted sound signals R and L and generate an added sound signal and a subtracted sound signal, respectively. These added sound signal and the subtracted sound signal are outputted to the gain adjustment unit 216.

Afterwards, the gain adjustment unit 216 receives the added sound signal from the adder 212, the subtracted sound signal from the subtracter 214 and the sound signals R and L that are provided from an external sound signal providing apparatus (not shown) and are unchanged. The gain adjustment unit 216 adjusts those inputted sound signals to predetermined gains $Q_1$, $Q_2$, $Q_3$ and $Q_4$. Herein, the predetermined gains $Q_1$, $Q_2$, $Q_3$ and $Q_4$ mean appropriate gains in accordance with the number and locations of target virtual sound sources. Also, the predetermined gains $Q_1$ to $Q_4$ can be identical or different reciprocally and can be variable as being predetermined by corresponding to the virtual sound source providing mode inputted by a user. The gain adjustment unit 216 includes more than one gain corresponding to the virtual sound source providing mode inputted by the user and selects an optimal gain from among the more than one gain by corresponding to the virtual sound source providing mode with respect to the target virtual sound sources. The adjusted sound signals are transferred to the signal transfer filter unit 218.

The signal transfer filter unit 218 generates more than one virtual sound signal ($V_1$, $V_2$, . . . , $V_n$) through a predetermined filtering process with respect to the above adjusted sound signals. Herein, the predetermined filtering process is carried out by optimal signal transferring filters $W_1$, $W_2$, $W_3$ and $W_4$ according to the number and locations of the target virtual sound sources. Herein, the optimal signal transferring filter $W_1$, $W_2$, $W_3$ and $W_4$ can be identical or different reciprocally and can be variable as being predetermined by corresponding to the virtual sound source providing mode inputted by the user. That is, the signal transfer filter unit 218 includes more than one signal transferring filter corresponding to the virtual sound source providing mode inputted by the user and selects the optimal signal transferring filters $W_1$ to $W_4$ from among the more than one signal transferring filter by corresponding to the virtual sound source providing mode with respect to the target virtual sound sources. The selected optimal signal transferring filters $W_1$, $W_2$, $W_3$ and $W_4$ determine the number of the virtual sound signals ($V_1$, $V_2$, . . . , $V_n$). The determined number of virtual sound signals ($V_1$, $V_2$, . . . , $V_n$) is at least more than one and is outputted to the virtual sound signal downmix unit 230.

Figure 5:
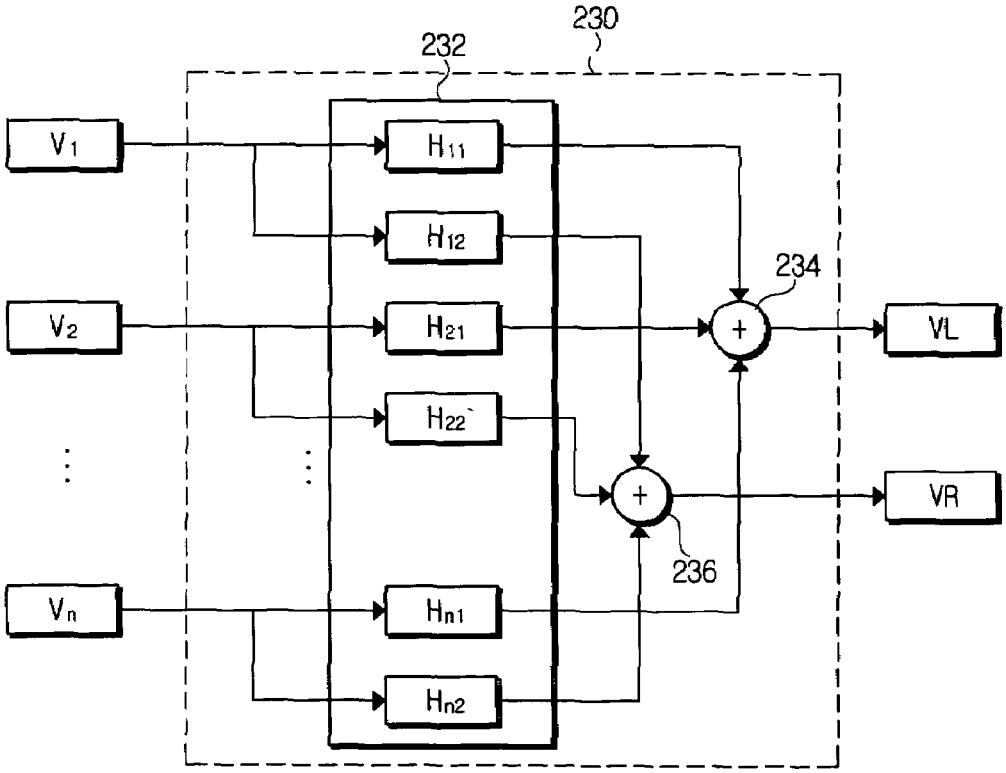
FIG. 5 is a block diagram showing an inner side of a virtual sound source downmix unit shown in FIG. 3.

FIG. 5 is a block diagram showing an inner side of the virtual sound signal downmix unit shown in FIG. 3. The virtual sound signal downmix unit 230 includes more than one spatial transfer function processing unit 232, a left adder 234 and a right adder 236. In this exemplary embodiment of the present invention, only the left and right adders 234 and 236 are illustrated since the frontal left and right speakers 250 and 260 are employed in the sound reproducing apparatus 200 shown in FIG. 3. Therefore, in the case of employing speakers exceeding more than two channels, the number of adders increases in proportion to the number of employed speakers.

The spatial transfer function processing unit 232 receives virtual sound signals ($V_1$, $V_2$, . . . , $V_n$) outputted from the signal transfer filter unit 218, and then processes the virtual sound signals ($V_1$, $V_2$, . . . , $V_n$) by using spatial transfer functions ($H_{11}$, $H_{12}$, $H_{21}$, $H_{22}$, . . . , $H_{n1}$, $H_{12}$), where n is a positive number. Herein, the spatial transfer functions ($H_{11}$, $H_{12}$, $H_{21}$, $H_{22}$, . . . , $H_{n1}$, $H_{n2}$) are coefficients for modeling a transmission path from virtual sound sources to ear drums of ears of a user and have values varying depending on a relative location between the selected virtual sound source and the user. As a result of this variable characteristic, it is possible to process the locations of the virtual sound sources to be transferred to certain locations in a three-dimensional space with the application of the spatial transfer functions ($H_{11}$, $H_{12}$, $H_{21}$, $H_{22}$, . . . , $H_{n1}$, $H_{n2}$).

The spatial transfer function processing unit 232 performs an intended process by separating individually each virtual sound signal ($V_1$, $V_2$, . . . , $V_n$) outputted from the signal transfer filter unit 218 into a left spatial transfer function ($H_{11}$, $H_{21}$, . . . , $H_{n1}$) and a right spatial transfer function ($H_{12}$, $H_{22}$, . . . , $H_{n2}$). The virtual sound signals processed by the left spatial transfer function ($H_{11}$, $H_{21}$, . . . , $H_{n1}$) are outputted to the left adder 234, and the virtual sound signals processed by the right spatial transfer function ($H_{12}$, $H_{22}$, . . . , $H_{n2}$) are outputted to the right adder 236.

The left adder 234 and the right adder 236 add the virtual sound signals processed according to each of the left and right spatial transfer functions ($H_{11}$, $H_{12}$, $H_{21}$, $H_{22}$, . . . , $H_{n1}$, $H_{n2}$), and then generate a left virtual sound signal output VL and a right virtual sound signal output VR, respectively. The left and right virtual sound signal outputs VL and VR are in a state of composing virtual sound signals together based on the number of the virtual sound signals, that is, the number of the target virtual sound sources.

As described above, the left virtual sound signal output VL and the right virtual sound signal output VR are outputted through the interference elimination unit 240 to the frontal left speaker 250 and the frontal right speaker 260, respectively, as shown in FIG. 3. At this time, the left virtual sound signal output VL and the right virtual sound signal output VR are outputted as a left virtual sound source VLS and a right virtual sound source VRS, respectively.

Figure 6:
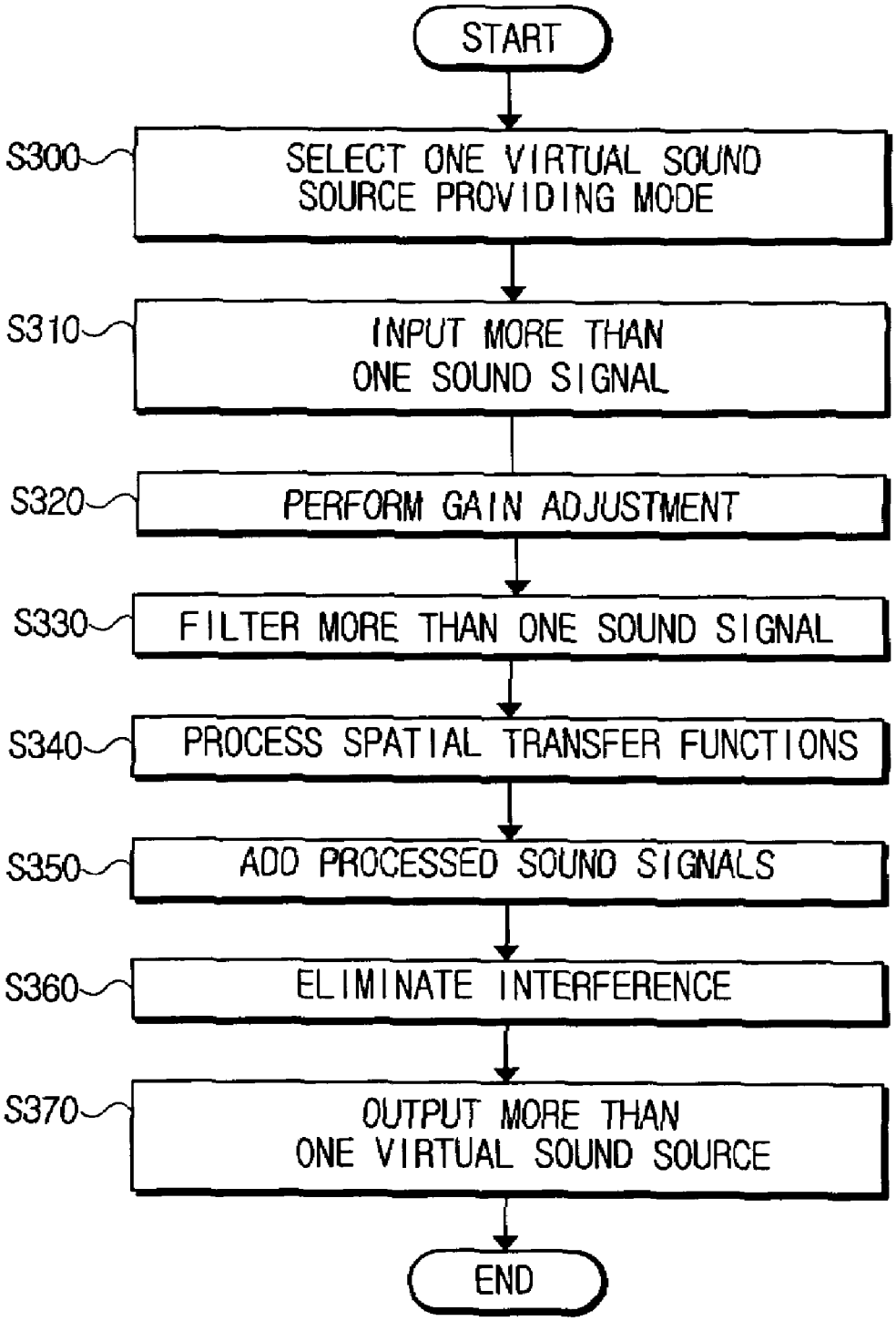
FIG. 6 is a flowchart for describing a sound reproducing method in accordance with an exemplary embodiment of the present invention.

FIG. 6 is a flowchart for describing a sound reproducing method for providing an optimal virtual sound source in accordance with an exemplary embodiment of the present invention.

Referring to FIGS. 2 to 6, at step S300, when a user listens to inputted sound signals, he/she selects one intended virtual sound source providing mode among more than one virtual sound source providing mode through the input unit 220 of the sound reproducing apparatus 200.

At step S310, in a case that a plurality of sound signals are inputted to the sound reproducing apparatus 200, the sound signals are outputted to the gain adjustment unit 216 of the sound reproducing apparatus 200. At the time of outputting the sound signals to the gain adjustment unit 216, the adder 212 and the subtracter 214 operate individually on the sound signals, thereby inputting an added sound signal and a subtracted sound signal to the gain adjustment unit 216.

At step S320, the added sound signal, the subtracted sound signal and the unchanged original sound signals that are inputted to the gain adjustment unit 216 are adjusted by the predetermined optimal gains $Q_1$ to $Q_4$ according to the virtual sound source providing mode selected by the user.

At step S330, the above adjusted sound signals are filtered by the signal transfer filter unit 218 through the use of the predetermined optimal signal transferring filters $W_1$ to $W_4$ according to the selected virtual sound source providing mode. As a result of the filtering process, at least more than one virtual sound signal ($V_1$, $V_2$, . . . , $V_n$) is generated.

At step S340, said at least more than one virtual sound signal ($V_1$, $V_2$, . . . , $V_n$) is processed by the left and right spatial transfer functions ($H_{11}$, $H_{12}$, $H_{21}$, $H_{22}$, . . . , $H_{n1}H_{n2}$).

Afterwards, at step S350, the virtual sound signals processed by the left spatial transfer function ($H_{11}$, $H_{21}$, . . . , $H_{n1}$) are added by the left adder 234 to generate the left virtual sound signal output VL, while the virtual sound signals processed by the right spatial transfer function ($H_{12}$, $H_{22}$, . . . , $H_{n2}$) are added by the right adder 236 to generate the right virtual sound signal output VR.

Subsequently, at step S360, the left virtual sound signal output VL and the right virtual sound signal output VR are subjected to an interference elimination process through the use of the interference elimination unit 240.

Lastly, at step S370, the left sound signal output VL and the right sound signal output VR without the interference phenomenon are outputted as a left virtual sound source VLS and a right virtual sound source VLR through the left speaker 250 and the right speaker 260, respectively.

In accordance with exemplary embodiments of the present invention, instead of applying the number and locations of standardized virtual sound sources by a conventional sound technology, the number and locations of diversely variable virtual sound sources are provided. Thus, there is an advantage that at least one optimal virtual sound source can be provided adaptively depending on each different environment. Since the number and locations of virtual sound sources can be determined by a type of a sound reproducing apparatus, it is also possible to take a sound reproducing environment in consideration. Also, depending on a type of a sound reproducing mode, the number and locations of virtual sound sources can be determined, and thus, sound effects can be maximized as being reproduced. Furthermore, there is another effect of eliminating a need of an additional operation since the number and locations of virtual sound sources determined by the type of the sound reproducing apparatus or the type of the sound reproducing mode are directly applied with respect to the number and locations of the virtual sound sources calculated from an external source.

The foregoing embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A sound reproducing apparatus, comprising:

a virtual sound signal generation unit which generates more than one virtual sound signal corresponding to locations and a number of target virtual sound sources on the basis of more than one inputted sound signal; and a virtual sound signal downmix unit which downmixes said more than one virtual sound signal to virtual sound signal outputs corresponding to a predetermined number of output channels, wherein the virtual sound signal generation unit includes:

an adder which adds at least two sound signals selected from among said more than one inputted sound signal and generates an added sound signal;

a subtracter which subtracts at least two sound signals selected from among said more than one inputted sound signal and generates a subtracted sound signal; and a gain adjustment unit which adjusts said more than one inputted sound signal, the added sound signal and the subtracted sound signal to predetermined optimal gains by corresponding to locations and the number of the target virtual sound sources.

2. The sound reproducing apparatus as recited in claim 1, wherein the virtual sound signal generation unit further includes a signal transfer filter unit which filters said more than one inputted sound signal, the added sound signal and the subtracted sound signal, which are adjusted, with use of predetermined optimal signal transferring filters by corresponding to locations and the number of the target virtual sound sources to thereby generate said more than one virtual sound signal.

3. The sound reproducing apparatus as recited in claim 1, wherein the virtual sound signal downmix unit includes:

a spatial transfer function processing unit which separates said more than one virtual sound signal such that said more than one virtual sound signal corresponds to said predetermined number of output channels and processes each separated virtual sound signal by using a respective spatial transfer function such that said each separated virtual sound signal corresponds to a respective one of the output channels; and at least one adder of which number corresponds to the number of the output channels and which adds said each separated virtual sound signal processed by the respective spatial transfer function such that said each virtual sound signal corresponds to a respective output channel.

4. The sound reproducing apparatus as recited in claim 1, further including an input unit which selects one virtual sound source providing mode from among more than one virtual sound source providing mode corresponding to the number and locations of target virtual sound sources.

5. The sound reproducing apparatus as recited in claim 4, wherein the virtual sound source signal generation unit generates more than one virtual sound source signal corresponding to the number and locations of target virtual sound sources based on the selected virtual sound source providing mode when the one virtual sound source providing mode is selected from among said more than one virtual sound source providing mode through the use of the input unit.

6. The sound reproducing apparatus as recited in claim 1, wherein locations and the number of target virtual sound sources are determined by considering one of a type of a sound reproducing mode and a type of a sound reproducing apparatus.

7. The sound reproducing apparatus as recited in claim 1, wherein the predetermined number of output channels is two.

8. The sound reproducing apparatus as recited in claim 3, wherein each of said more than one virtual sound signal is separated into a number of signals corresponding to said predetermined number of output channels.

9. The sound reproducing apparatus as recited in claim 1, wherein the virtual sound signal downmix unit includes:

a spatial transfer function processing unit which separates each of said more than one virtual sound signal into a number of separated virtual sound signals corresponding to said predetermined number of output channels and processes each of said separated virtual sound signals by using a respective spatial transfer function; and at least one adder, wherein each one of said at least one adder generates a summation by adding a corresponding separated virtual sound signal of each one of said more than one virtual sound signal.

10. A method for reproducing sounds, comprising:

generating more than one virtual sound signal corresponding to locations and a number of target virtual sound sources on the basis of more than one inputted sound signal; and downmixing said more than one virtual sound signal to more than one virtual sound signal output corresponding to a predetermined number of output channels, wherein said generating more than one virtual sound signal includes:

generating an added sound signal by adding at least two sound signals selected from among said more than one inputted sound signal;

generating a subtracted sound signal by subtracting at least two sound signals selected from among said more than one inputted sound signal; and adjusting said more than one inputted sound signal, the added sound signal and the subtracted sound signal to optimal gains predetermined by corresponding to locations and the number of the target virtual sound sources, and wherein at least one of said generating more than one virtual sound signal and said downmixing said more than one virtual sound signal is performed using a processor.

11. The method as recited in claim 10, wherein said generating more than one virtual sound signal further includes generating said more than one virtual sound signal through filtering said more than one inputted sound signal, the added sound signal and the subtracted sound signal, which are adjusted, with use of optimal signal transferring filters predetermined by corresponding to locations and the number of the target virtual sound sources.

12. The method as recited in claim 10, wherein said downmixing said more than one virtual sound signal to more than one virtual sound signal output includes:

separating each virtual sound signal in a manner to correspond to said predetermined number of output channels and processing each separated virtual sound signal by using spatial transfer functions each being separated in such a manner as to correspond to a respective one of the output channels; and adding said each separated virtual sound signal processed by the separate spatial transfer functions such that said each separated virtual sound signal corresponds to a respective output channel through the use of at least one adder of which number corresponds to the number of the output channels.

13. The method as recited in claim 10, further including selecting one virtual sound source providing mode from among more than one virtual sound source providing mode corresponding to the number and locations of target virtual sound sources.

14. The method as recited in claim 13, wherein at said generating said more than one virtual sound signal, when one virtual sound source providing mode is selected from among said more than one virtual sound source providing mode, said more than one virtual sound signal corresponding to locations and the number of target virtual sound sources is generated on the basis of the selected one virtual sound source providing mode.

15. The method as recited in claim 10, wherein the number and locations of target virtual sound sources are determined by considering one of a type of a sound reproducing mode and a type of a sound reproducing apparatus.

16. The method as recited in claim 10, wherein the predetermined number of output channels is two.

17. The method as recited in claim 12, wherein each of said more than one virtual sound signal is separated into a number of signals corresponding to said predetermined number of output channels.

18. The method as recited in claim 10, wherein said downmixing said more than one virtual sound signal to more than one virtual sound signal output includes:

separating each of said more than one virtual sound signal into a number of separated virtual sound signals corresponding to said predetermined number of output channels and processing each of said separated virtual sound signals by using a respective spatial transfer function; and adding a corresponding separated virtual sound signal of each one of said more than one virtual sound signal, to generate a respective summation of separated virtual sound signals corresponding to each output channel.

19. A sound reproducing apparatus, comprising:

a virtual sound signal generation unit which generates more than one virtual sound signal corresponding to locations and a number of target virtual sound sources on the basis of more than one inputted sound signal; and a virtual sound signal downmix unit which downmixes said more than one virtual sound signal to virtual sound signal outputs corresponding to a predetermined number of output chanels, wherein the virtual sound signal generation unit includes:

an adder which adds at least two sound signals selected from among said more than one inputted sound signal and generates an added sound signal;

a subtracter which subtracts at least two sound signals selected from among said more than one inputted sound signal and generates a subtracted sound signal; and a signal transfer filter unit which filters said more than one inputted sound signal, the added sound signal and the subtracted sound signal with use of optimal signal transferring filters predetermined by corresponding to the number and locations of the target virtual sound sources to thereby generate said more than one virtual sound signal.

20. A method for reproducing sounds, comprising:

generating more than one virtual sound signal corresponding to locations and a number of target virtual sound sources on the basis of more than one inputted sound signal; and downmixing said more than one virtual sound signal to more than one virtual sound signal output corresponding to a predetermined number of output channels, wherein said generating more than one virtual sound signal includes:

generating an added sound signal by adding at least two sound signals selected from among said more than one inputted sound signal;

generating a subtracted sound signal by subtracting at least two sound signals selected from among said more than one inputted sound signal; and generating said more than one virtual sound signal through filtering said more than one inputted sound signal, the added sound signal and the subtracted sound signal, which are adjusted, with use of optimal signal transferring filters predetermined by corresponding to locations and the number of the target virtual sound sources, wherein at least one of said generating more than one virtual sound signal and said downmixing said more than one virtual sound signal is performed using a processor.

* * * * *